US006357551B1

(12) United States Patent
Bogardus, III

(10) Patent No.: US 6,357,551 B1
(45) Date of Patent: Mar. 19, 2002

(54) FLEXIBLE LADDER

(76) Inventor: VanNess H. Bogardus, III, 22359 Ironhorse Dr., Grass Valley, CA (US) 95949

( * ) Notice: Subject to any disclaimer, the term of this patent is extended or adjusted under 35 U.S.C. 154(b) by 0 days.

(21) Appl. No.: 09/474,115

(22) Filed: Dec. 29, 1999

(51) Int. Cl.[7] ..... E06C 1/52
(52) U.S. Cl. ..... 182/196; 182/190
(58) Field of Search ..... 182/196, 100, 182/189, 93, 190; 114/362

(56) References Cited

U.S. PATENT DOCUMENTS

| | | | | |
|---|---|---|---|---|
| 277,389 | A | | 5/1883 | Weed |
| 686,182 | A | | 11/1901 | Wright |
| 3,216,030 | A | | 11/1965 | Garfield |
| 3,817,351 | A | | 6/1974 | Mikkelson |
| 4,405,034 | A | | 9/1983 | Dunne |
| 4,577,726 | A | | 3/1986 | Wheeler |
| 5,020,633 | A | | 6/1991 | Rangel |
| 5,628,380 | A | | 5/1997 | Matisi |
| 5,848,667 | A | * | 12/1998 | Davidson ..... 182/196 |

* cited by examiner

*Primary Examiner*—Alvin Chin-Shue
(74) *Attorney, Agent, or Firm*—Heisler & Associates

(57) ABSTRACT

A flexible ladder constructed of nylon webbing straps includes a central weight-bearing strap having terminal loops at both ends, and a plurality of opposed pairs of side loops for hand and foot placement. A second embodiment of the ladder has a primary weight-bearing strap with loops projecting from one side, this second embodiment being adapted to being folded in half for hoisting heavier loads.

6 Claims, 5 Drawing Sheets

FLEXIBLE LADDER

BACKGROUND OF THE INVENTION

1. Field of the Invention

The present invention relates generally to equipment for climbing and rescue, and more specifically to non-rigid ladders and sling assemblies.

2. Description of the Related Art

Various non-rigid, ladder-like structures are known for climbing, rescue and tactical use. Folding ladders of the type constructed with a pair of parallel lengths of rope, cable or chain with rigid rungs spanning the space therebetween are heavy, bulky, noisy and difficult to pack and transport. Further, unless used with extreme care, their rigid hardware damages adjacent objects and surfaces.

Ladders made entirely of rope are lighter and more flexible, thus being easier to pack into a stuff sack and transport. However, a ladder made entirely of rope normally needs at least two fixed, spaced-apart anchor points at the top of its length in order to permit a user to place a hand or foot on a rung without being obstructed by the sidelines. Even when the side-lines are so separated, placing weight on the center of a rope rung tends to draw the adjacent portions of the side-lines thereabove toward one another, thus giving the ladder an unwieldy V-shape. To combat this problem, fixed anchor points are required at the bottom ends of the side-lines, as well as at the top, which makes the use of such ladders all the more laborious in set-up, and limited in application.

One device that overcomes the dual side-line problem is a rope ladder having side-to-side alternating, i.e. staggered, loops. Such a device is shown in U.S. Pat. No. 4,405,034 issued to Dunne in 1983. Dunne's device hangs from a single fixed point. However, rope tangles easily, and is very uncomfortable for anything but very temporary use. Standing in rope loops in bare feet or soft-soled shoes gets painful very quickly. And, wrapping a wrist into a rope loop for a better grip soon chafes the skin on the back of the hand and wrist. Further, rope loops can act as a tourniquet, quickly cutting off circulation in a limb. Therefore, sliding a leg through a loop up to the thigh, or an arm to the armpit, to rest for any length time could be dangerous. Yet further, alternating, opposed loops such as Dunne discloses offer no comfortable resting position for a climber. One leg must always be straight, and one bent. Switching legs to alleviate fatigue requires moving a step up or down, which could be very inconvenient, for example, in rescue or tactical situations.

A ladder-like device known as an "etriet," shaped very similarly to Dunne's rope ladder, is constructed of ½-inch to one-inch bar-tacked, flat, tubular nylon. This solves some of the problems of rope ladders, in that the material's flattened width spreads the pressure over a greater skin surface, making it a bit easier on the hands, wrists and feet. But, such etriets, having alternating, staggered loops similar to those in Dunne's rope ladder, fail to solve the problem of providing a way for a person to hang for long periods of time comfortably in one spot. Further, if an etriet is constructed of the limpest nylon fabric for maximum wrist-wrapping comfort, the loops thereof will be very difficult to step into without the aid of the climber's hands. That is, although the climber may be able to slide a hand easily through a very limp-hanging loop to achieve a secure wrist-wrapped grasp, poking the toe of a shoe or boot through a limp-material loop is nearly impossible, without holding the loop open by hand.

U.S. Pat. No. 4,577,726 issued to Wheeler in 1986 shows one method of keeping the loops open and foot-accessible in an etriet-type ladder, specifically, by adding an additional layer of strap material to the under-foot portion of each loop. Wheeler suggests this added layer helps a loop stand out, away from the central, weight-bearing strap assembly of the device. Presumably, this extra layer stiffens the loop, and/or weights its lower portion, thus helping keep it open. However, in most instances where an etriet-type ladder might be used, the convenience of Wheeler's multi-layered loop construction is likely a poor trade-off in that it appears to result in a weight increase of some fifty percent, or so, over that of a similar device with conventionally-constructed loops.

Rescue and tactical personnel also frequently need equipment able to function as a sling for feeble and injured persons. One simple sling construction commonly used merely comprises a loop of wide, flat nylon webbing material which can be wrapped around the pelvic and torso area of a person, and attached to the end of a length of line for raising or lowering the person. Alternatively, and most simply, the person may sit within the loop, grasping the upper portion of the loop with both hands, with the buttocks area supported by the lower end of the loop, while the upper end of the loop is attached to a line or other lifting device. Unfortunately, both such uses of single-loop slings of this type accommodate only one person. Further, a feeble person, such as an accident victim, may not balance well in the lower end of a single hanging loop; safety demands holding on tight with both hands. Otherwise, this risks additional injury. And, the wrap-around use of such a loop may be difficult to secure to a trapped or feeble user.

Thus, it appears that a need exists for a soft, flexible, quiet, light-weight ladder adapted for easy, comfortable and safe hand and foot placement, and for single anchor-point attachment. It would also be desirable if such ladder could accommodate a resting climber staying in one position for a long time, without causing hand or foot fatigue, or loss of circulation in a limb. Further, as it is advantageous for climbers, rescue and tactical personnel to have equipment which serves multiple functions, it would also be highly desirable if such a rescue ladder could serve the additional purpose of a safe and secure rescue sling.

SUMMARY OF THE INVENTION

The flexible ladder of the present invention is adapted to overcome the above-noted shortcomings and to fulfill the stated needs. One embodiment thereof is constructed of a primary weight-bearing strap, and a plurality of pairs of directly-opposed side loops depending therefrom, wherein at least one loop includes a half twist.

A second embodiment includes a primary weight-bearing strap, with a plurality of side loops depending from one side thereof, wherein at least one loop includes a half twist.

It is an object of the present invention to provide a flexible ladder constructed of limp, soft material which is very comfortable to grasp and hold, yet which, at once, includes hand and foot-hold loops which open very easily for the hand and foot.

It is another object of the present invention to provide a ladder at once useful to police personnel; firemen; spelunkers; swiftwater technicians; vertical rescue and escape technicians; helicopter rescue personnel; and, personnel involved in tactical and covert operations, as well as those in various other sports, activities and professions.

A further object of the present invention to provide a piece of equipment for climbing, rescue and tactical use which is light-weight, packs easily and serves multiple functions including that of ladder, a rescue sling and also a general-purpose tether and gear-hauling device.

Still further objects of the inventive flexible ladder disclosed herein will be apparent from the drawings and following detailed description thereof.

DESCRIPTION OF THE PREFERRED EMBODIMENT

Figure 1:
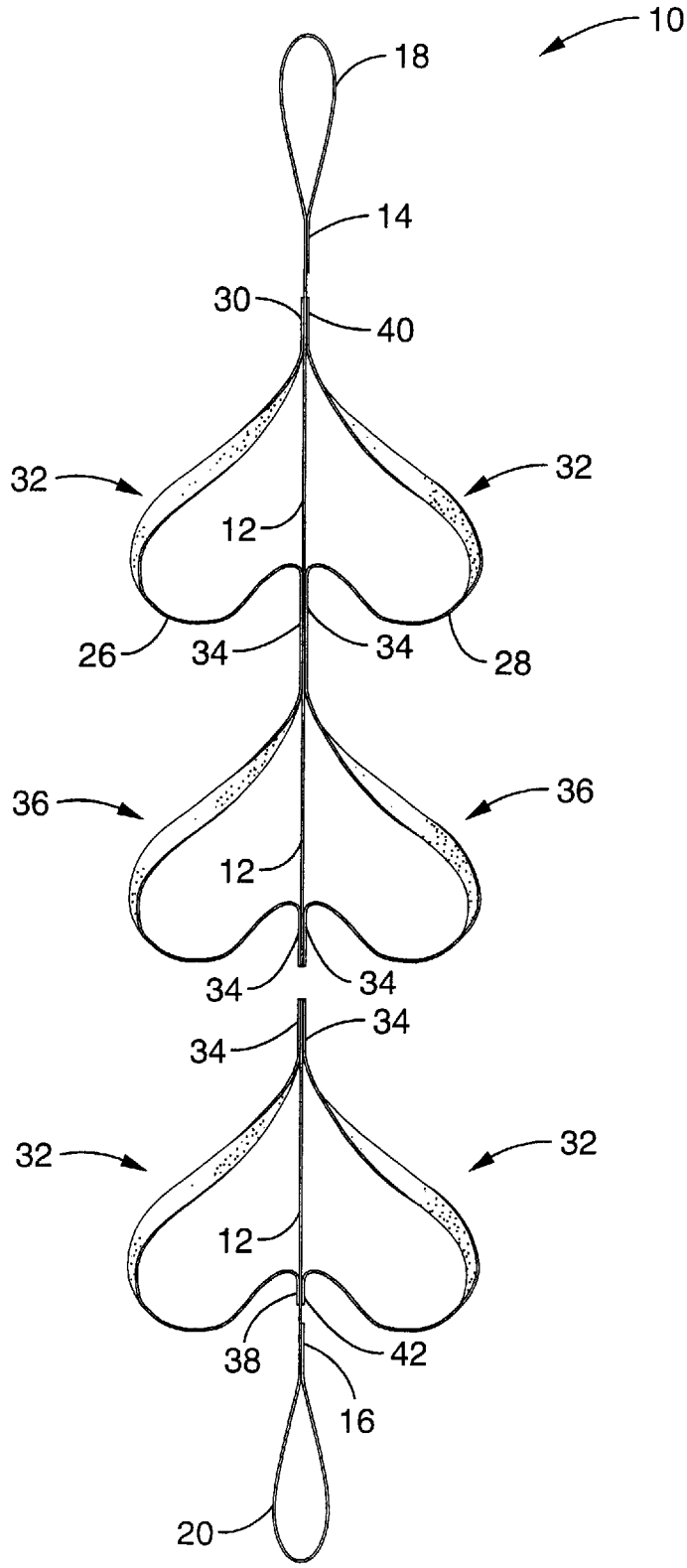
FIG. 1 is a fragmentary plan view of a first embodiment of the flexible ladder of the invention as it would appear laid out upon a flat, horizontal surface.
Figure 2:
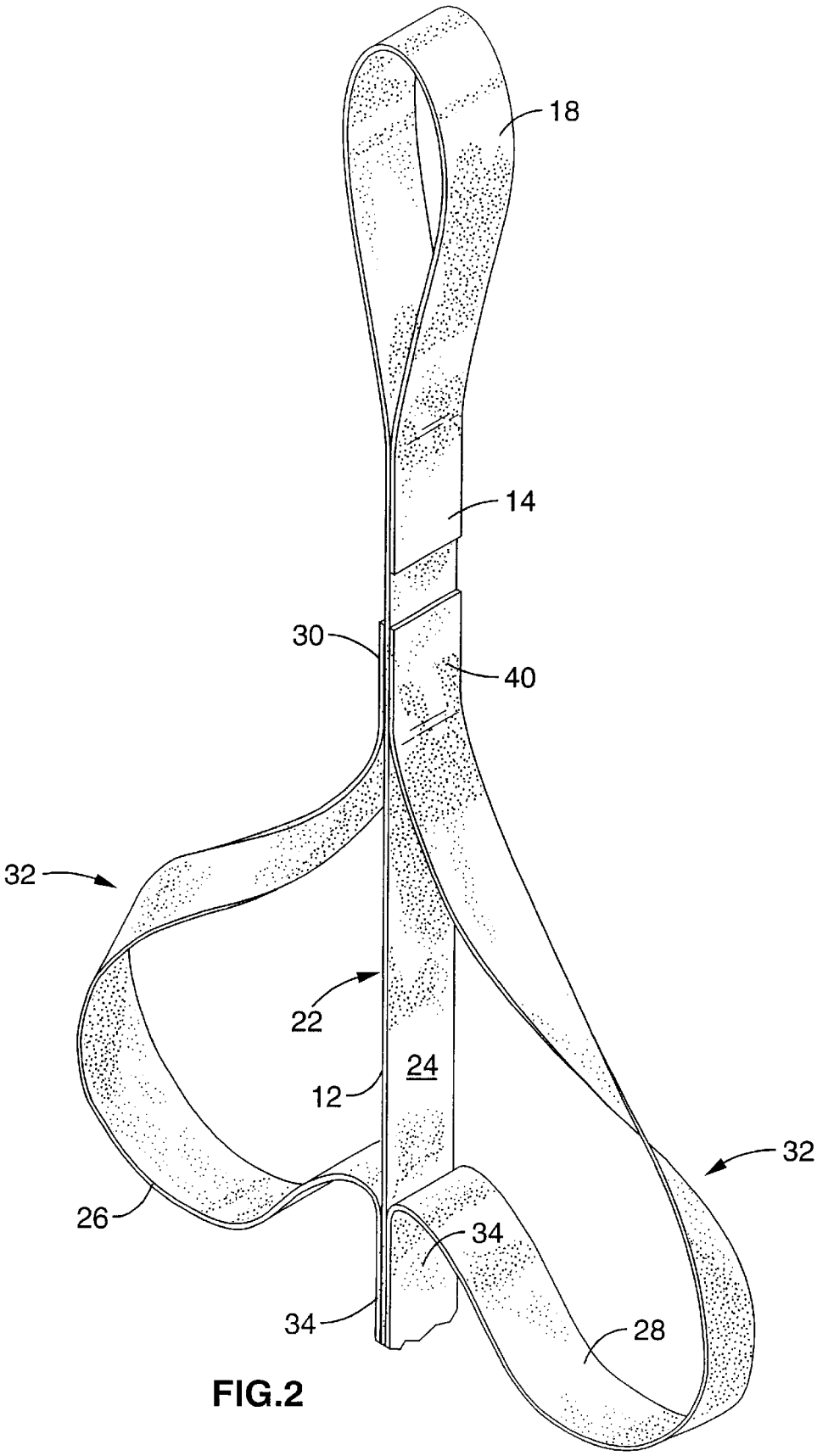
FIG. 2 is an enlarged fragmentary perspective view showing the upper end of the flexible ladder of FIG. 1 with its upper side loops held in more of an open orientation than they would hang naturally, just to show the half twists in the loop straps.

Referring now specifically to the drawings, FIGS. 1 and 2 show a first embodiment of the ladder of the invention, which is generally identified herein with reference numeral 10. Ladder 10 is constructed entirely of wide, strong, flexible strap material. Flat, soft, single-ply, finely-woven nylon webbing having at least a 15,000 pound break strength is preferred. However, it will be understood that other strap materials, either natural, synthetic or blended, and either woven or nonwoven, may have the same or superior qualities for practicing the invention. Thus, it will be understood that the invention is not limited to the strap materials specifically disclosed and claimed herein.

Ladder 10 includes a plurality of points where pieces of webbing are bound or otherwise attached to one another. All such attachment points comprise parallel lengths of webbing, face-to-face, flush against one another, with their side edges aligned. It will be understood that at all of those points it is preferred that a rescue-quality, rescue load-bearing, solvent-resistant, ultraviolet light-resistant means of attachment be used. It is also preferred that the break strength of the attachments used be as close as possible to the break strength of the strap material of ladder 10. It is expected that heavy-duty, bar-tacked stitching with ultraviolet light-resistant nylon thread will suffice. However, other types of stitching, adhesives or welding, or combinations of these among themselves, or these in combination with other means or methods, may work as well or better than the preferred attachment means disclosed herein for achieving the purposes of the invention. Thus, it will be understood that such now known or later-discovered means are within the scope of the invention, including the claims.

When preferred approximate lengths of elements are discussed herein, it should be generally understood that bar-tacked or otherwise bound portions are included in those stated lengths. The length of any such bound portion is generally preferred to be at least equal to the width of the strap material at the bound point. However, different methods of binding or affixing pieces of strap material to one another may require much shorter or longer bound areas to achieve the goal of equaling, as closely as possible, the break strength of the strap material used.

Central strap 12 is the principal weight-bearing portion of ladder 10. Central strap 12 is preferably constructed of a 4-inch wide length of webbing, roughly 30 feet long. First and second ends 14 and 16 of central strap 12 are folded back and tacked down to form first and second 18-inch terminal end loops 18 and 20. The construction of first end loop 18 is shown in detail in FIG. 2; second end loop 20 is identical. This looping of central strap ends 14 and 16 results in ladder 10 having a preferred overall finished length of roughly 27 feet between the terminal tips of first and second end loops 18 and 20. The span of central strap 12 between first and second end loops 18 and 20 is roughly 24 feet long, and has first and second faces 22 and 24.

A secondary or ancillary strap, left side strap 26, is affixed to central strap 12's first face 22, and a right side strap 28 is affixed to central strap 12's second face. Left and right side straps 26 and 28 are of the same length, and are preferably constructed of the same 4-inch wide webbing as central strap 12.

As shown in FIG. 2, first end 30 of left side strap 26 is bar-tacked to first face 22 of central strap 12, near first end loop 18. An unbound portion of left side strap 26 directly adjacent its tacked first end 30 loops out and away from central strap 12's first face 22, and is tacked down again to first face 22 at an intra-span tack point 34. This looped-out portion of first side strap 26 is generally referred to herein as a terminal side loop 32. The webbing of terminal side loop 32 includes a twist, that being preferably a single half twist. In essence, a first face of side strap 26 is bound to central strap 12 at one end of terminal side loop 32, the twist causing a second face of side strap 26 to be bound to central strap 12 at terminal side loop's other end. Similarly, of strap 26's two side edges, a first is adjacent a first side edge of central strap 12 at one end of loop 32, and the second is adjacent that first side edge of central strap 12 at the other end of loop 32. (These first and second faces and edges of side strap 26 and edges of central strap 12, for simplicity, are not separately numbered in the drawings).

The distance along central strap 12 between left side strap 26's first end 30 and intra-span tack point 34 is preferably 18 inches. However, the looped-out webbing of terminal side loop 32 is preferably 44 inches long.

Progressing along first face 22 toward second end loop 20, left side strap 26 loops out repeatedly to form a plurality of half-twisted intra-span side loops 36 separated by intra-span tack points 34. Each intra-span tack point 34 is preferably 8 inches long, i.e. twice with width of the 4-inch strap material, as each intra-span tack point 34 serves to bound a flanking intra-span side loop 36 on each side. Each intra-span side loop 36 is 44 inches long and is bounded by, and bound to central strap 12's first face 22 at, two intra-span tack points 34. Second end 38 of left side strap 26 is tacked to first face 22 near second end loop 20, ending in a half-twisted terminal side loop 32.

The preferred embodiment of the invention includes sixteen side loops projecting from central strap 12's first face 22. These sixteen are comprised of two terminal side loops 32, one adjacent each end loop 18 and 20, and fourteen intra-span side loops 36.

Right side strap 28 is fastened to central strap 12's second face 24 in a manner generally identical to that described for left side strap 24 and first face 22. In summary, first end 40 of right side strap 28 is fastened to second face 24 adjacent first end loop 18. Right side strap 28 loops out to form a terminal side loop 32 bounded by, and bound at its other extent to second face 24 at, an intra-span tack point 34. The first terminal side loop 32 of right side strap 28 includes a half-twist, as do all fourteen intra-span side loops 36, and as does terminal side loop 32 formed where right side strap 28's second end 42 is tacked down adjacent second end loop 20.

Left and right terminal side loops 32, left and right intra-span tack points 34, and left and right intra-span side loops 36, are all disposed in directly-opposed pairs along central strap 12. The one primary difference in the structure of the side loops in right side strap 28 from those in left side strap 26 is that their half-twists are in opposite directions. For example, if the twists in left side strap 26 are left-hand twists, the twists in right side strap 28 will be right-hand twists. See FIG. 2. Left and right side straps 26 and 28 are thus attached to central strap 12's faces 22 and 24 in a mirror-image, but otherwise identical, manner. Thus, ladder 10 is bilaterally symmetrical with reference to the plane in which central strap 12 resides.

Terminal side loops 32 should be distinguished from end loops 18 and 20 at central strap 12's termini. Terminal side loops 32 are those side loops disposed closest first and second ends 30 and 38 of left side strap 26, and closest first and second ends 40 and 42 of right side strap 28.

In use for its primary purpose, which is climbing, ladder 10 may be suspended from a single anchor point. The loops of ladder 10 function as step straps which can be easily opened by a single toe or heel, or by an arm or leg, without the need to use an additional helping hand. Although this very beneficial aspect of the invention is best exhibited in an embodiment of ladder 10 constructed of the preferred 4-inch webbing, because the twist in webbing of such width presents a wider opening for ingress to the loop, ladders constructed of 3-inch, or even 2-inch, webbing still permit easier hand and foot entry than rope or straight-strapped constructions.

Further, the half-twisted orientation of the loops greatly facilitates a quickly-placed, secure wrist-wrap type grip, this feature giving ladder 10 considerable superiority over rope ladders, and over straight-strapped slings and related devices.

Yet further, one or more users are able to sit comfortably on ladder 10 by driving the legs through opposed loops up to the thigh. Loops above each seated user provide secure hand grips. Arms and legs of feeble or injured persons may be inserted through the loops very easily by those giving aid, or with little effort from the feeble or injured persons themselves. Once a person's arms and legs are inserted well into the loops of ladder 10, the downward-pulling weight of the person's limbs tends to hold the person's torso close to central strap 12, and keeps the person well-engaged with ladder 10. Even a single arm and a single opposed leg through ladder 10's loops is likely to be secure enough to hold a person well enough for safe hoisting or lowering.

Even further usefulness is found in the fact that this ladder can be thrown out over the edge of a cliff or roof edge, allowing a bottom portion thereof to hang ready for use. In this instance, the upper portion of the ladder acts as a suspension line and the lower portion, from the cliff or roof edge down, acts as a ladder. The upper portion of a ladder 10 draped as described is also useful in facilitating safe climbing up steep pitches.

Ladder 10 is also useful for hauling any type of gear or load vertically, or on a horizontal or pitched surface. This usefulness is primarily due to the ease with which loops 18, 28, 32 and 36 can be grasped and pulled, in contrast with conventional ropes and lengths of webbing.

Multiple ladders 10 may be strung together end-to-end by interlacing the top loop of one with the bottom loop of a ladder above, thus creating a similar ladder of extended length. Conventional hardware may be used to attach ladders to one another, as well. Yet further, intermediate loops of ladder 10 may be hung on pegs, pins or other projections to create multiple pitches of different lengths and angles, such as several horizontal or inclined pitches interspersed with vertical pitches. And, of course, each side loop on a horizontally-strung ladder 10 may provide a separate point from which yet another ladder 10 may depend.

Between uses, ladder 10 is easily stored in a fabric stuff bag, making it very easy to pack and transport with other odd-shaped equipment to wherever needed.

Figure 3:
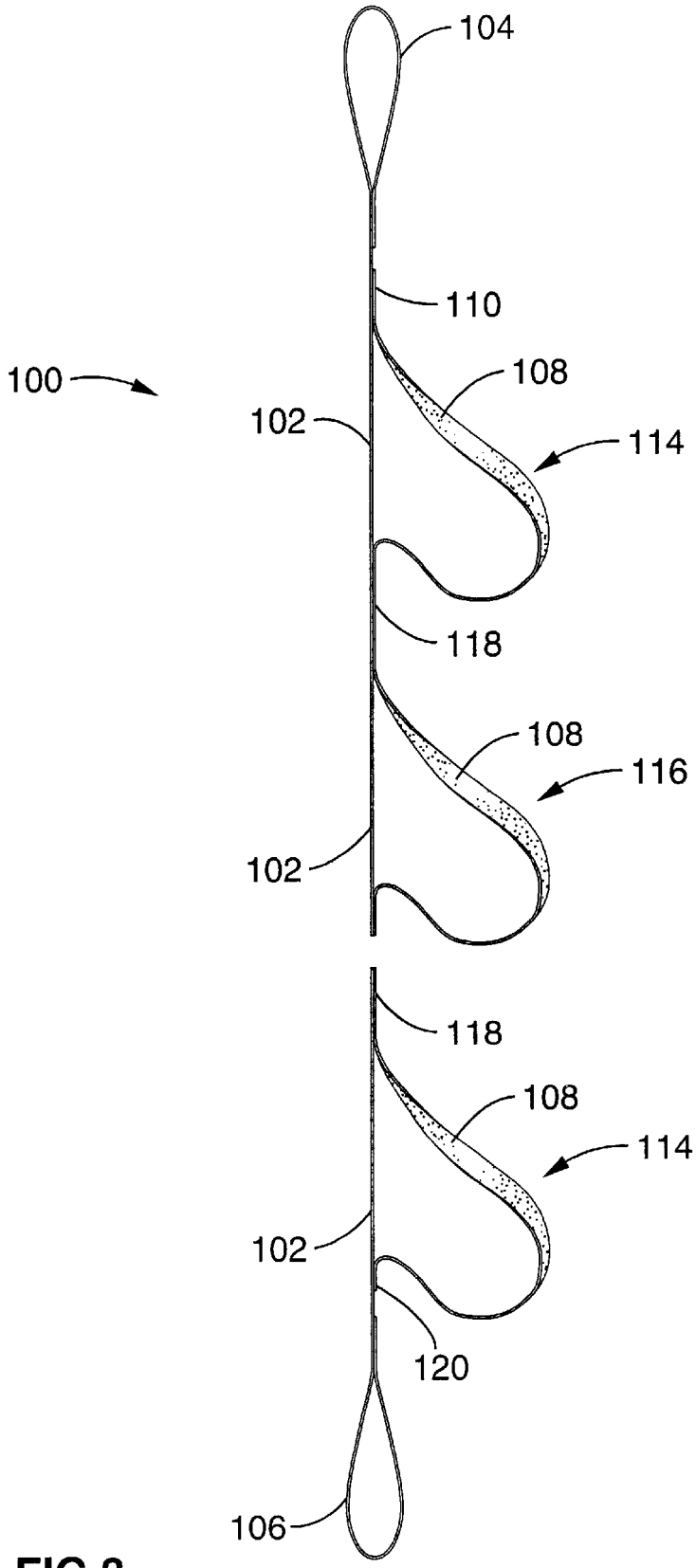
FIG. 3 is a fragmentary plan view of a second embodiment of the flexible ladder of the invention as it would appear laid out upon a flat, horizontal surface.
Figure 4:
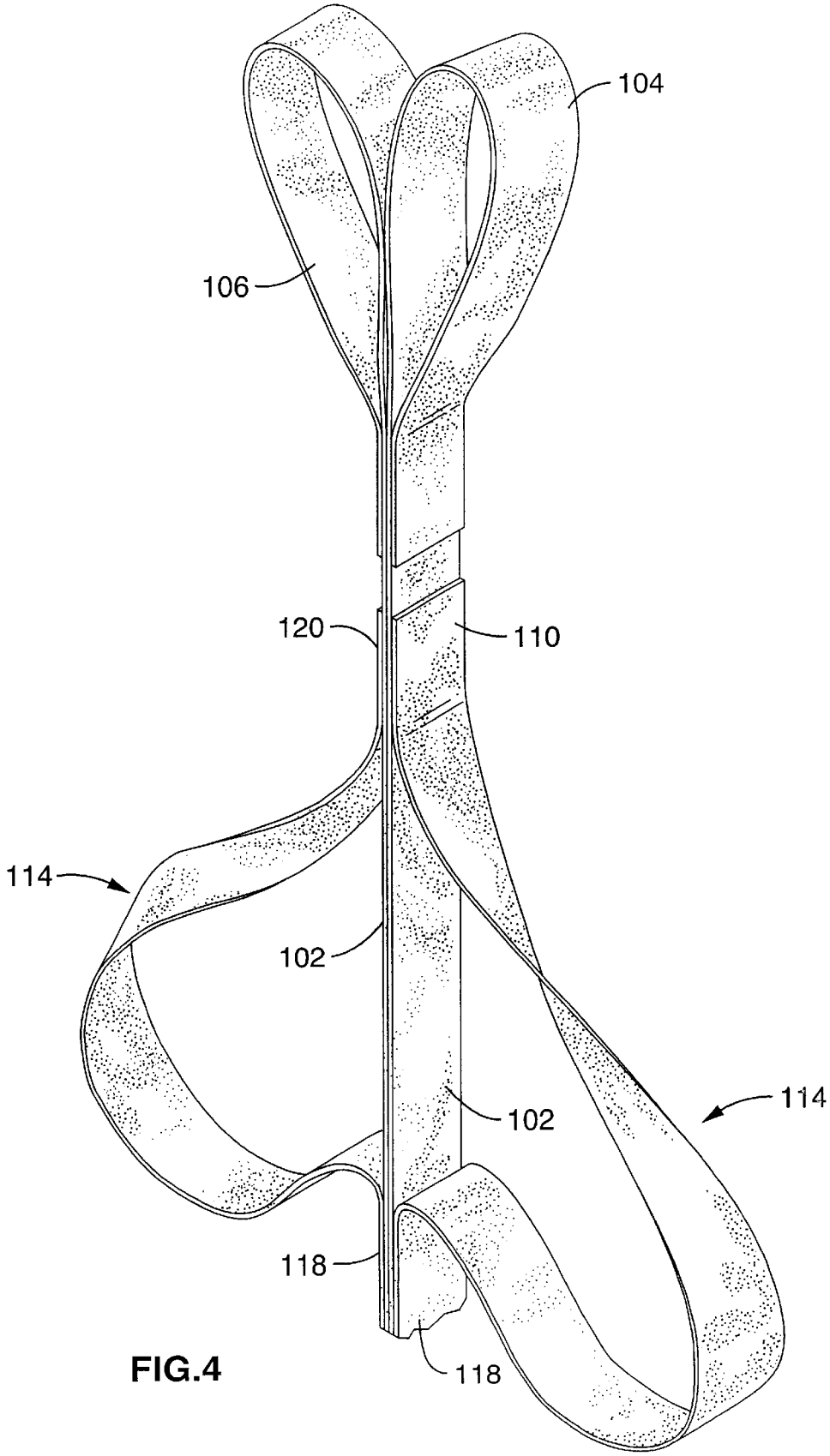
FIG. 4 is an enlarged fragmentary perspective view showing the upper end of the flexible ladder of FIG. 3 with its upper side loops held in more of an open orientation than they would hang naturally, just to show the half twists in the loop straps.
Figure 5:
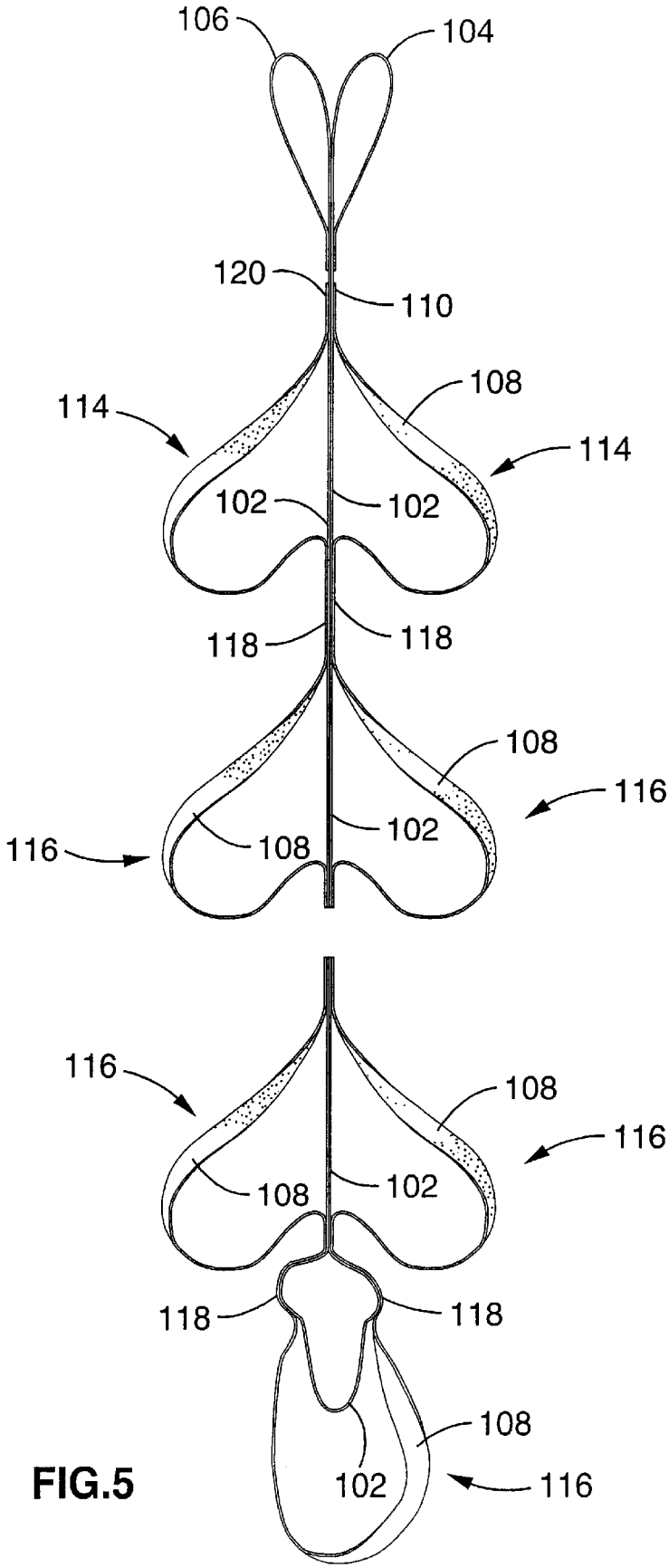
FIG. 5 is a fragmentary plan view of the flexible ladder of FIG. 3 as it would appear laid out upon a flat, horizontal surface, illustrating one preferred orientation of that embodiment wherein the primary weight-bearing strap thereof is folded in half; i.e. doubled.

A second embodiment of the flexible ladder of the invention is shown in FIGS. 3, 4 and 5. This second embodiment is generally identified herein with reference numeral 100. Ladder 100's principal weight bearing portion is primary strap 102. Primary strap 102 is preferably 4 inches wide and approximately 55.5 feet long. Primary strap 102's ends are folded back into first and second 18-inch end loops 104 and 106. Thus, the span of primary strap 102 between first and second end loops 104 and 106 is roughly 49.5 feet.

A single side strap 108 of ladder 100 has a first end 110 fastened to a first face 112 of primary strap 102 adjacent primary strap 102's first end loop 104. A 44-inch terminal side loop 114 of side strap 108 loops out and is bound back to primary strap 102 at an intra-span tack point 116 approximately 18 inches from side strap 108's first end 110. This first terminal side loop 114 includes a half-twist, as do thirty-one intra-span side loops 116 tacked down at 18-inch intervals to primary strap 102 at intra-span tack points 118. A second terminal side loop 114 adjacent second end loop 106 also includes a half twist. Second end 120 of side strap 108 is tacked down adjacent second end loop 106. Thus, ladder 100 includes thirty-three side loops, all affixed to first face 112 of primary strap 102. Other numbers of side loops may be employed in ladder 100, however it is preferred that an odd number of loops be used.

As shown in FIG. 5, ladder 100 may be folded in half, so that end loops 104 and 106 are juxtaposed. This yields approximately double the load bearing capacity of first ladder embodiment 10, while adding only the weight of one additional length of central strap material. In this orientation, the middle odd-numbered side loop, e.g. here the seventeenth side loop, serves the purpose of an end loop.

Ladder 100 may be used in any of the ways set forth above for ladder 10. It may also be hung over a limb, beam or pipe with end loops 104 and 106 hanging downward and linked with a carabiner, for example.

It should be understood that although ladders 10 and 100 are shown in the drawing figures with their loops splayed open, these loops will not be so oriented in general use. They are depicted in an open orientation here to make clear their half twisted structures. Loops constructed of the preferred soft, limp, flexible webbing material will hang nearly vertically in actual use. But, the half-twist construction disclosed herein makes them much easier to enter and grasp than would be apparent were they depicted as they naturally hang.

The foregoing detailed disclosure of the inventive ladder is considered as only illustrative of the preferred embodiment of, and not a limitation upon the scope of, the invention. Those skilled in the art will envision many other possible variations of the structure disclosed herein that nevertheless fall within the scope of the following claims. For example, floats could be added to ladder 10 for various aquatic uses. And, other hardware could be added to serve different purposes.

Alternative uses for this inventive ladder may also later be realized. Accordingly, the scope of the invention should be determined with reference to the appended claims, and not by the examples which have herein been given.

I claim:

1. A ladder, comprising:

a. an elongate primary strap having first and second ends, first and second opposed faces and first and second side edges;

b. a first elongate ancillary strap, longer than said primary strap, said ancillary strap having first and second ends, first and second opposed faces and first and second side edges;

c. a second elongate ancillary strap, similar in length to said first ancillary strap, said second ancillary strap having first and second ends, first and second opposed faces and first and second side edges;

d. a plurality of bound portions of said first ancillary strap's length, said bound portions being parallel to, flush-faced against, edge-aligned with and bound to said primary strap;

e. a plurality of unbound portions of said ancillary strap's length, each said unbound portion being between two said bound portions;

f. a twist in an unbound portion of said first ancillary strap;

g. a plurality of bound portions of said second ancillary strap's length, said bound portions being parallel to, flush-faced against, edge-aligned with and bound to said primary strap;

h. a plurality of unbound portions of said second ancillary strap's length, each said unbound portion being between two said bound portions; and i. a twist in an unbound portion of said second ancillary strap.

2. The ladder of claim 1, wherein said first of two bound portions of said first ancillary strap, and said first of two bound portions of said second ancillary strap, are disposed at similar distances from said first end of said primary strap, and wherein said second of two bound portions of said first ancillary strap, and said second of two bound portions of said second ancillary strap, are disposed at similar distances from said first end of said primary strap.

3. A ladder comprising:

a. an elongate primary weight-bearing strap;

b. a first elongate ancillary strap, longer than said primary weight-bearing strap;

c. a second elongate ancillary strap, similar in length to said first ancillary strap;

d. a plurality of bound portions of said first ancillary strap's length, said bound portions being bound to said primary weight-bearing strap;

e. a plurality of unbound portions of said first ancillary strap's length, each said unbound portion being between two said bound portions;

f. a twist in an unbound portion of said first ancillary strap;

g. a plurality of bound portions of said second ancillary strap's length, said bound portions being bound to said primary weight-bearing strap;

h. a plurality of unbound portions of said second ancillary strap's length, each said unbound portion being between two said bound portions; and i. a twist in an unbound portion of said second ancillary strap.

4. The ladder of claim 3, wherein said first of two bound portions of said first ancillary strap, and said first of two bound portions of said second ancillary strap, are disposed at similar distances from said first end of said primary strap, and wherein said second of two bound portions of said first ancillary strap, and said second of two bound portions of said second ancillary strap, are disposed at similar distances from said first end of said primary strap.

5. A ladder comprising:

a. an elongate primary weight-bearing strap having first and second ends, first and second opposed faces and first and second edges;

b. a first elongate step strap, longer than said primary weight-bearing strap, said step strap having first and second ends, first and second opposed faces and first and second edges;

c. a second elongate step strap, similar in length to said first step strap, said step strap having first and second ends, first and second opposed faces and first and second edges;

d. a plurality of bound portions of said first step strap's length, said bound portions being parallel to, flush-faced against, edge-aligned with and bound to said primary weight-bearing strap;

e. a plurality of unbound portions of said first step strap's length, each said unbound portion being between two said bound portions;

f. a twist in an unbound portion of said first step strap;

g. a plurality of bound portions of said second step strap's length,s aid bound portions being parallel to, flush-faced against, edge-aligned with and bound to said primary weight-bearing weight-bearing strap;

h. a plurality of unbound portions of said second step strap's length, each said unbound portion being between two said bound portions; and i. a twist in an unbound portion of said second step strap.

6. The ladder of claim 5, wherein a bound portion of said first step strap closest to said first end of said primary strap, and a bound portion of said second step strap closest to said first end of said primary strap, are disposed at similar distances from said first end of said primary strap.

* * * * *